US009976575B2

(12) United States Patent
Gonzaga et al.

(10) Patent No.: US 9,976,575 B2
(45) Date of Patent: May 22, 2018

(54) DEVICE FOR FEEDING A FLUID TO A CONTAINER, SUCH AS AN ACTUATOR, ASSEMBLY FOR ACTIVATING OR MOVING AN OBJECT, AS WELL AS LIFTING DEVICE FOR A TYRED WHEEL OR A TYRE

(71) Applicant: Butler Engineering & Marketing S.p.A., Rolo (Reggio Emilia) (IT)

(72) Inventors: Tullio Gonzaga, Correggio-Reggio Emilia (IT); Silvano Santi, Sasso Marconi (IT)

(73) Assignee: BUTLER ENGINEERING AND MARKETING S.P.A., Rolo (Reggio Emilia) (IT)

( * ) Notice: Subject to any disclaimer, the term of this patent is extended or adjusted under 35 U.S.C. 154(b) by 375 days.

(21) Appl. No.: 14/717,671

(22) Filed: May 20, 2015

(65) Prior Publication Data

US 2015/0337870 A1 Nov. 26, 2015

(30) Foreign Application Priority Data

May 23, 2014 (IT) ..... VR2014A0146

(51) Int. Cl.
*F15B 11/08* (2006.01)
*B66F 7/06* (2006.01)
*B66F 7/08* (2006.01)

(52) U.S. Cl.
CPC ..... *F15B 11/08* (2013.01); *B66F 7/065* (2013.01); *B66F 7/08* (2013.01); *Y10T 137/85954* (2015.04)

(58) Field of Classification Search
CPC .. F15B 11/08; F15B 9/08; B66F 7/065; B66F 7/08
USPC ..... 91/29, 447, 361
See application file for complete search history.

(56) References Cited

U.S. PATENT DOCUMENTS

| | | | | |
|---|---|---|---|---|
| 2,480,916 | A | 2/1945 | Gibson | |
| 4,905,742 | A * | 3/1990 | Mohs | B60S 5/043 137/224.5 |
| 5,253,672 | A | 10/1993 | Uehara et al. | |
| 2007/0134080 | A1* | 6/2007 | Simard | B60B 29/002 414/426 |
| 2010/0051390 | A1 | 3/2010 | Buzzi | |
| 2010/0063637 | A1* | 3/2010 | Crowell | B66F 7/16 700/279 |

FOREIGN PATENT DOCUMENTS

| | | |
|---|---|---|
| DE | 2837773 A1 | 3/1980 |
| DE | 20316905 | 3/2005 |

(Continued)

OTHER PUBLICATIONS

European Search Report for Italian Patent Application No. VR2014A000146.

*Primary Examiner* — F. Daniel Lopez
*Assistant Examiner* — Daniel Collins
(74) *Attorney, Agent, or Firm* — Tutunjian & Bitetto, P.C.

(57) ABSTRACT

The present invention relates to a device for feeding a fluid to a container including a supplying line for supplying the fluid, an end for the inlet of the fluid into the supplying line, a dispensing end for dispensing the fluid into the container, and an opening/closing valve member intercepting the supplying line and which is movable between a closing position and an opening position.

23 Claims, 4 Drawing Sheets

(56) References Cited

FOREIGN PATENT DOCUMENTS

| | | | |
|---|---|---|---|
| FR | 1026383 | | 4/1953 |
| FR | 1343743 | | 10/1963 |
| GB | 846161 | | 8/1960 |
| WO | WO86/06054 | | 10/1986 |
| WO | WO2008085462 | | 7/2008 |
| WO | WO2008085462 | A1 | 7/2008 |

* cited by examiner

DEVICE FOR FEEDING A FLUID TO A CONTAINER, SUCH AS AN ACTUATOR, ASSEMBLY FOR ACTIVATING OR MOVING AN OBJECT, AS WELL AS LIFTING DEVICE FOR A TYRED WHEEL OR A TYRE

TECHNICAL FIELD OF THE INVENTION

The present invention concerns a device for feeding a fluid to a container, such as an actuator, an assembly for activating or moving an object, for example a lifting plane of a tyre, as well as a device for lifting a tyre, possibly equipped with the aforementioned assembly for activating or moving.

STATE OF THE ART

Up to now many tyre lifting devices have been proposed, like for example those taught by the following patents or patent applications US20100051390A1, FR1026383A, FR1343743A, GB846161A, U.S. Pat. No. 2,480,916A, WO8606054A1, DE20316905U1 or WO2008085462A1.

Such devices are usually equipped with an actuator with a stem intended to thrust an arm of a cross-frame supporting a lifting plane, with a cam-follower roller fitted onto the end of the stem and intended to engage a cam rising from the base of the device.

The devices according to such solutions thus require the use, amongst other things, of a suitably designed and shaped cam so as to ensure lifting of the plane.

With these devices it is difficult to obtain an efficient operation, considering both the structure of the respective components and the sliding engagement between cam-follower and cam.

Concerning this, it should be noted that with the devices for feeding for feeding pressurised fluid into the actuators, the optimal pressure for feeding air to the cylinder of the actuator depends, amongst other things, on the type of wheel to be lifted or rather on the size and weight thereof. Taking this into account, it often happens that a wheel is lifted by feeding air with an excessively high pressure, in particular because the operator places the wheel on the plane and presses the activation pedal of the device, without then taking any particular precaution to limit the pressure of the air to the value actually necessary to lift the wheel.

Moreover, the problem of feeding a fluid at a correct pressure exists not only in the case of supplying air to an actuator, but also in other cases in which it is required to fill or feed a container with a fluid, in particular a gaseous fluid (be it air, nitrogen, a combustible fluid or other fluid etc.) at a controlled pressure.

SUMMARY OF THE INVENTION

The main purpose of the present invention is to provide a new device for feeding a fluid to a container, in particular a device for feeding a fluid under pressure to the cylinder of an actuator, possibly an actuator for moving a lifting plane of tyred wheels.

Another purpose of the present invention is to provide a device as stated above that is able to ensure efficient operation.

Another purpose of the present invention is to provide a device as stated above that is able to supply a gaseous fluid at a correct feeding pressure.

Another purpose of the present invention is to provide a new assembly for activating or moving an object.

Another purpose of the present invention is to provide a new lifting device.

Another purpose of the present invention is to provide a new lifting device that has a simple structure, but that is still capable of ensuring quick and reliable lifting.

In accordance with an aspect of the invention a device is foreseen according to claim 1.

In accordance with another aspect of the invention an assembly for activating or moving is foreseen according to the present specification.

In accordance with another aspect of the invention a device for lifting a tyre is foreseen according to the present specification.

In accordance with another aspect of the invention a method for feeding a fluid to a container is foreseen according to the present specification.

In accordance with another aspect of the invention a method for lifting-lowering wheels or tyres is foreseen according to the present specification.

The dependent claims refer to preferred and advantageous embodiments of the invention.

BRIEF DESCRIPTION OF THE DRAWINGS

Other characteristics and advantages of the invention will become clearer from the description of an embodiment of a device for feeding, illustrated for indicating purposes in the attached drawings, in which.

In the attached drawings parts or component that are the same are marked with the same reference numerals.

DETAILED DESCRIPTION OF THE INVENTION

In the present description the expressions "upstream" and "downstream" are correlated to the direction of flow of the fluids in the device and, with reference for example to a first and to a second component on the fluid supplying line, the expression "the first component is upstream of the second component" indicates that the first component of the device is arranged before the second component and thus treats the fluid of the device before or immediately before it is treated by the second component, whereas the expression "the first component is downstream of the second component" indicates that the first component of the device is arranged after the second component and therefore treats the fluid of the device after or immediately after it has been treated by the second component.

Figure 1:
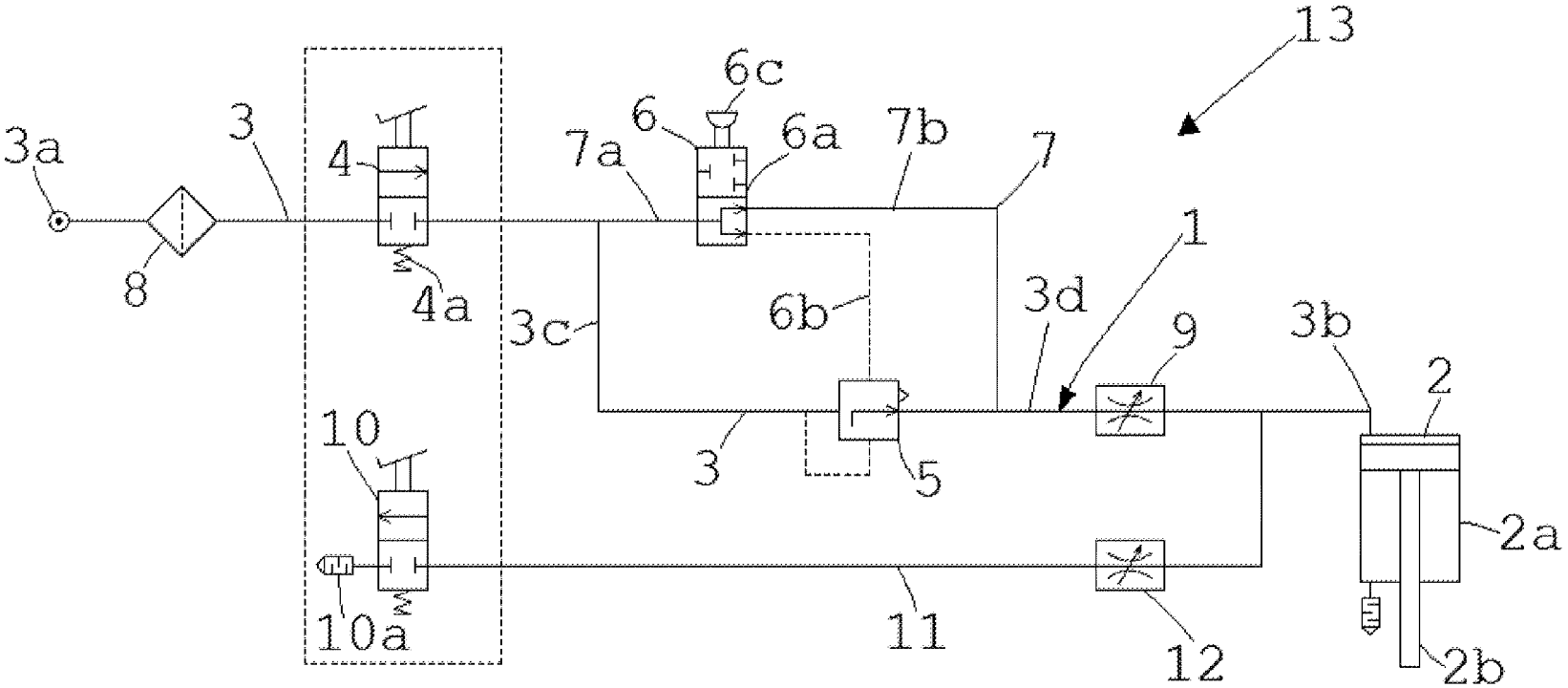
FIG. 1 is a schematic view of a device for feeding according to the present invention as well as an assembly for activating or moving an object in accordance with the present invention provided with such a device for feeding.
Figure 2:
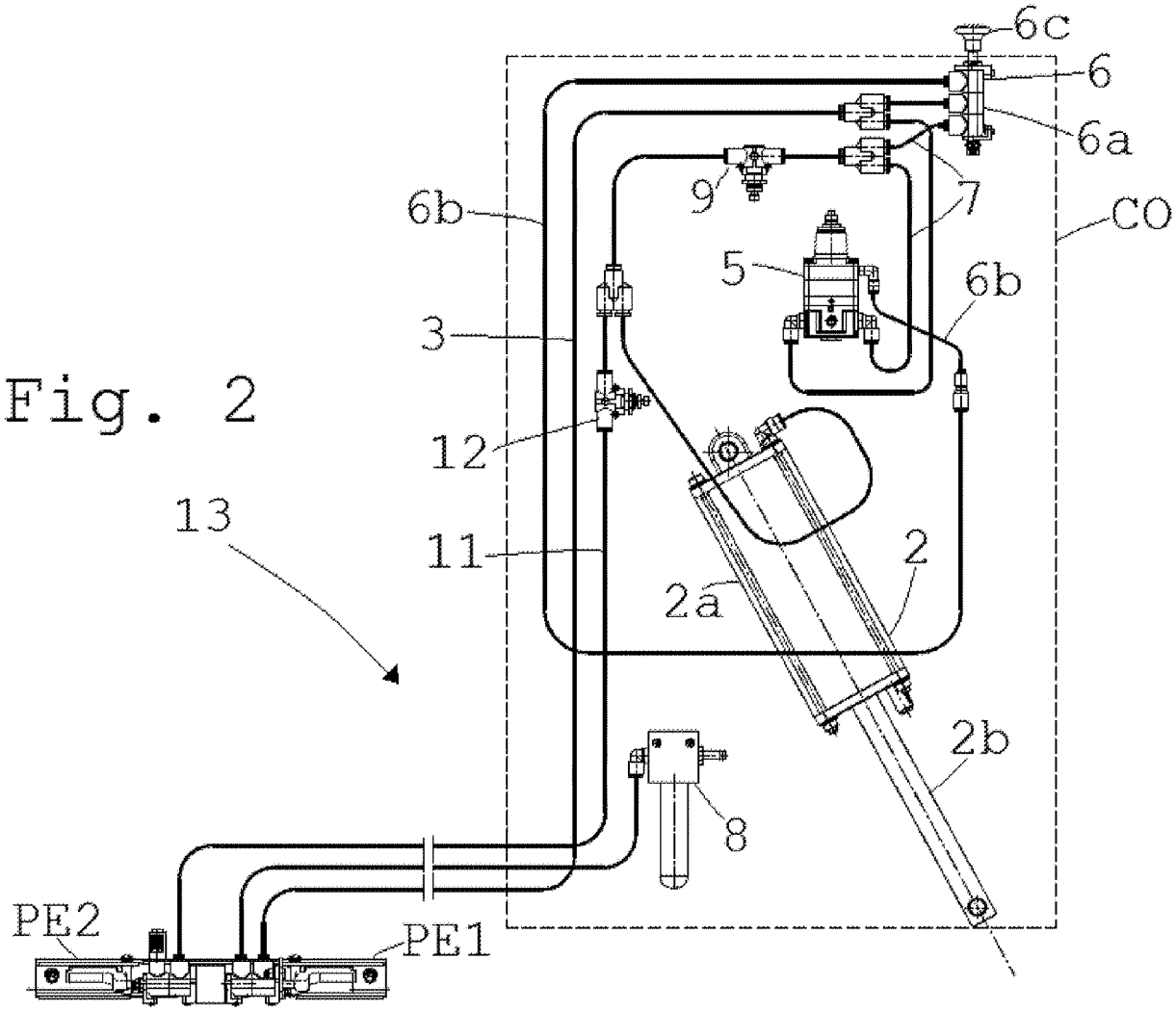
FIG. 2 represents the assembly for activating or moving of FIG. 1.
Figure 3:
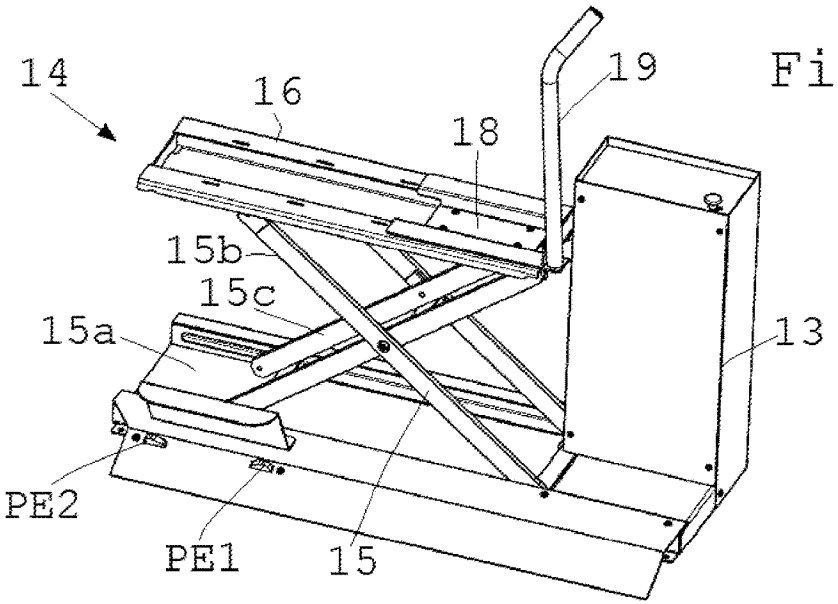
FIG. 3 is a perspective view slightly from above of a lifting device according to the present invention.
Figure 5:
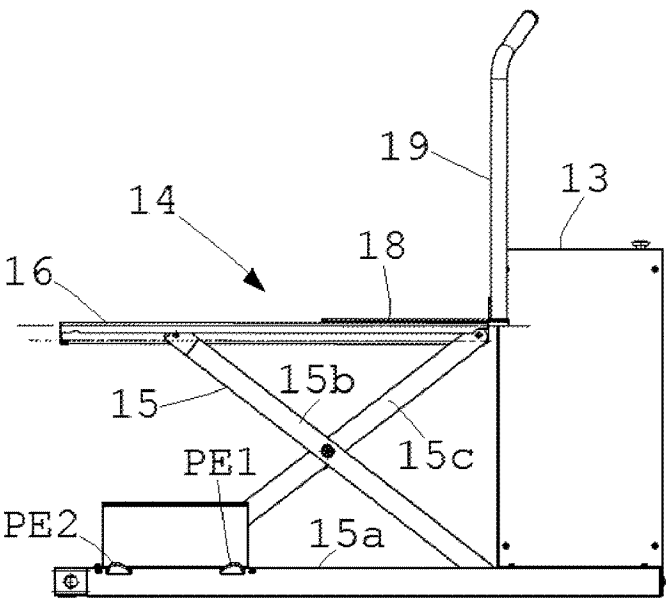
FIGS. 4 and 5 are side views of the lifting device of FIG. 3 in two respective operative positions.
Figure 4:
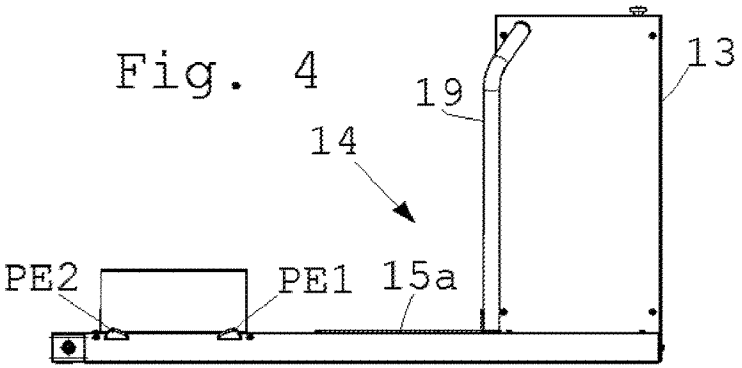
Figure 7:
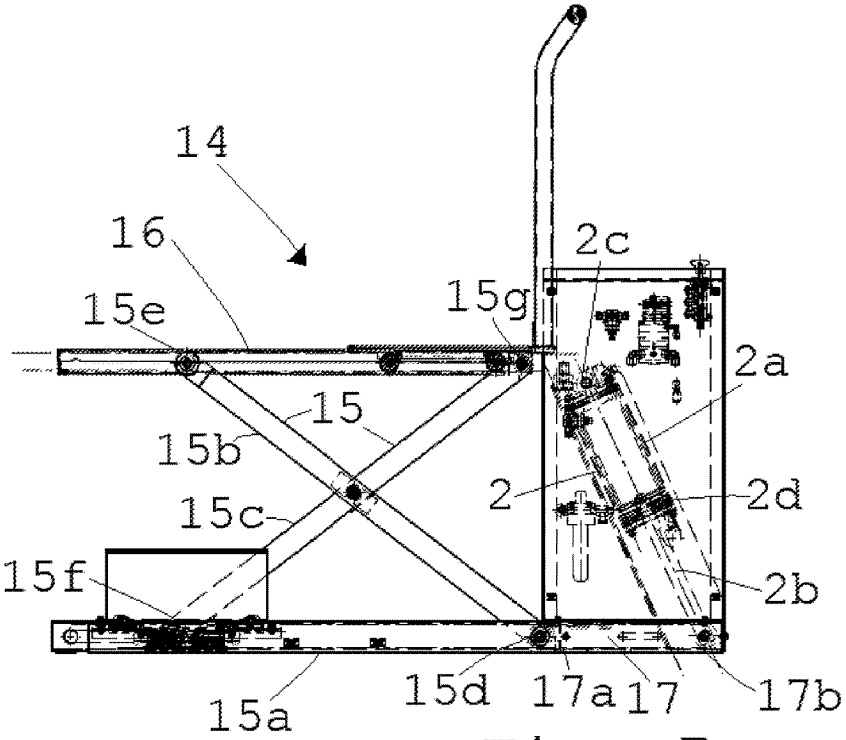
FIGS. 6 and 7 are views similar, respectively, to FIGS. 4 and 5 but with parts in transparency.
Figure 6:
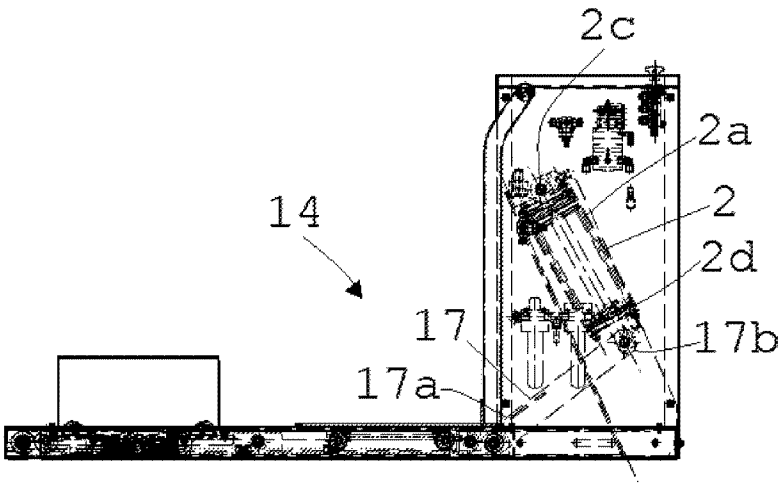

With reference first to FIGS. 1 and 2, a device 1 according to the present invention for feeding a fluid is illustrated, preferably a gaseous fluid, possibly under pressure, for example pressurised air, to a container 2, preferably to a chamber or cylinder of a container, even more preferably closed or fluid tight.

Preferably, the container 2 comprises an actuator or rather a cylinder thereof, for example a linear actuator, a double-acting actuator or an actuator of another type, but it should be understood that the container could also be another, although preferably it will have a variable volume to be filled through the fluid and moreover a movable wall for delimiting the variable volume of the container or a component fixed or operatively connected to it will be subjected to a force to be overcome or to a load or weight to be moved, for example to be lifted. Concerning this, if the container is an actuator, then the variable filling volume thereof is that of the cylinder of the actuator, whereas the movable stem is fixed or operatively connected to a wall delimiting the cylinder and is subjected to a reaction force of an external element to be moved, for example a plane to be lifted and supporting a wheel or a tyre.

The device for feeding comprises at least one supplying line 3 for supplying the fluid, as well as at least one inlet end 3*a* for the inlet of the fluid into the supplying line 3, which inlet end 3*a* being intended to be placed in fluid communication with a fluid source, for example with a compressor or with the outside.

The device 1 further comprises at least one dispensing end 3*b* for dispensing fluid into the container 2, into which end 3*b* the supplying line 3 opens, in other words the fluids fed into the latter open into the dispensing end 3*b* and thus into the container 2.

There is also at least one opening/closing valve member or opening/closing valve 4 of the supplying line 3, which intercepts the supplying line 3 and is movable between a closing position in which it obstructs the fluid supplying between inlet end 3*a* and dispensing end 3*b*, and therefore in the container 2, and one or more opening positions in which it allows fluid supplying between inlet end 3*a* and dispensing end 3*b*. The opening/closing valve member 4 can for example comprise a valve having two or more positions, possibly calibrated or calibratable, for example elastically loaded, so as to be able to be opened or moved in contrast with the action of a spring or elastic loading element 4*a*.

It should be understood that the opening/closing valve member 4 could also be part of the fluid source (possibly the compressor) and be associated with the other components of the device for feeding 1 when it is connected to the fluid source, and thus the expression according to which the device for feeding comprises an opening/closing valve 4 is to construed also taking into account of such a variant.

The device for feeding 1 also comprises at least one pressure adjuster or pressure adjusting member 5, for example a pressure reducer, which intercepts the supplying line 3 and is intended to receive in input the fluid at an inlet pressure, established mainly by the fluid source and, possibly by the components upstream of the pressure adjuster, and to supply it at an outlet pressure.

The pressure adjusting member has a variable outlet pressure, for example, an outlet pressure variable as a function of the fluid pressure in inlet and/or of the structure/arrangement of its components and of possible forces applied to them.

Preferably, the outlet pressure from the pressure adjusting member substantially corresponds to the outlet pressure of the supplying line 3 at the dispensing end 3*b* and therefore to the pressure supplied to the container 2, although downstream of the pressure adjusting member 5 it is also possible to foresee further elements that reduce the pressure of the fluid, but still, preferably, elements that reduce the pressure in a constant and non-adjustable manner, so that the pressure of the fluid in outlet from the supplying line 3 is proportional to the outlet pressure from the adjusting member 5.

Possibly, the adjusting member 5 can have a variable through-flow section, so that by varying the through-flow section of the adjusting member 5 there is consequently a variation of the outlet pressure from it and therefore from the supplying line 3.

The device can further comprise storing means or locking/unlocking means 6 movable between a condition of setting or fixing of the outlet pressure from the pressure adjuster and a resting condition. Preferably, in the resting condition, the locking/unlocking means 6 neither fix nor set the outlet pressure of the pressure adjuster.

Possibly, the storing means or locking/unlocking means 6 can be of the on/off type or with only two conditions or positions, in other words a condition or position of setting or fixing of the outlet pressure from the pressure adjuster and a resting condition or position.

If the adjusting member has a variable through-flow section, the storing or locking/unlocking means are movable between a condition of setting or fixing of the through-flow section and an at least partial unlocking condition of the through-flow section, in which they neither fix nor block the through-flow section.

Advantageously, the device 1 comprises one or more branch lines 7 of the supplying line 3, whereas the locking/unlocking means 6 comprise a control valve 6*a* arranged to intercept the supplying line 3 or, if foreseen, the branch line 7 as well as at least one fluid connecting conduit 6*b* extending between the control valve 6*a* and the pressure adjusting member 5. The control valve 6*a* divides the branch line 7 into an upstream portion 7*a* upstream of the control valve 6*a* and a downstream portion 7*b*.

The control valve 6*a* is, preferably, movable between a first position in which it allows the passage of fluid from the supplying line 3 or from the branch line 7 to the connecting conduit 6*b*, or rather between upstream portion 7*a* of the branch line 7 and connecting conduit 6*b*, and a second position in which it closes the connecting conduit 6*b* or rather the fluid communication between supplying line 3 or branch line 7 and the connecting conduit 6*b*. Preferably, in the first position, the control valve allows the passage of fluid from the branch line 3 or from the branch line 7 or rather from the upstream portion 7*a* thereof to the connecting conduit 6*b*, whereas in the second position, the control valve 6*a* closes the fluid connection between the supplying line 3 and the connecting conduit 6*b* or from the branch line 7, if foreseen, and the connecting conduit 6*b*. Therefore, in the case in which the branch line 7 is foreseen, when the control valve 6*a* is in the second position, it closes the fluid communication between the upstream portion 7*a* and the downstream portion 7*b* of the branch line 7, as well as the connection between the branch line 7 and the connecting conduit 6*b*, whereas in the first position, it allows the fluid communication between upstream portion 7*a* and downstream portion 7*b* of the branch line 7.

The locking/unlocking means 6 can also comprise a button 6*c* for the actuation or movement of the control valve 6*a* between the first and the second position. The button 6*c* can be manually actuated by pressing by an operator and, in this case, it will project out from the container or casing CO of the device for feeding 1. Possibly, the button 6*c* or in any case the locking/unlocking means could also be automatically actuated, possibly controlled or able to be controlled remotely by an operator or through a suitable control unit, in which case the device for feeding could also comprise suitable sensor means for detecting variables indicative of the efficiency, the speed or in any case of how the feeding of the container is proceeding.

In this case, the flow adjuster 5 preferably comprises at least one chamber in which a membrane, possibly elastic, a spear valve or a movable wall is slidably mounted so as to vary the pressure in outlet from the pressure adjusting member 5 and the connecting conduit 6*b* is in fluid communication with the chamber and intended to supply fluid into it so as to bias the membrane, spear valve or movable wall and thus determine the pressure in outlet from the pressure adjusting member 5. The membrane, wall or spear valve can be suitably loaded, for example elastically loaded or in any case biased. In this case the connecting conduit 6*b* is intended to supply fluid into the chamber so as to move the membrane, spear valve or wall, thereby establishing or determining the through-flow section of the adjusting member 5 and therefore the outlet pressure.

The adjusting member 5 could also have a discharge duct, as well as a spear valve or a membrane that is movable as stated above through the storing means or through the fluid conveyed by the connecting conduit 6*b*, which spear valve/membrane is intended to control and adjust the flow of fluid through the adjusting member 5 so as to direct it in part towards the portion of the supplying line downstream of the pressure adjusting member and in part towards the discharge duct.

Preferably, the branch line 7 extends between a portion 3*c* of the supplying line 3 upstream of the flow adjuster 5 and a portion 3*d* of the supplying line 3 downstream of the flow adjuster 5 or between a portion 3*c* of the supplying line 3 upstream of the flow adjuster 5 and the flow adjuster 5 itself, for example the aforementioned chamber thereof.

The device for feeding can also comprise other components such as a filter 8 and/or a first flow adjuster 9, for example calibrated or calibratable, which can be arranged to intercept, for example, the supplying line 3, possibly a filter 8 arranged downstream of the inlet end 3*a* and upstream of the opening/closing valve 4. The first flow adjuster 9, if foreseen, can on the other hand be arranged, for example, downstream of the pressure adjuster 5, possibly downstream of the connecting portion of the branch line 7 or rather of the second portion 7*b* thereof with the supplying line 3.

Advantageously, the device for feeding 1 can also comprise a discharge valve 10 as well as a fluid discharge line 11 extending between an end portion of the supplying line 3 and the discharge valve 10 is for example substantially the same as the opening/closing valve and, possibly, equipped with a silencer 10*a*. The discharge line could extend from a portion of the supplying line 3 downstream both of the pressure adjuster 5 and of the branch line 7. The discharge valve 10 and the discharge line 11 are intended to discharge the supplying line 3, the container 2 and, if foreseen, the branch line 7 of the fluid previously inserted into them.

Moreover, the discharge line could also be foreseen directly from the actuator or from a cylinder thereof and therefore not extending from the supplying line.

The device for feeding 1 can also comprise a second flow adjuster 12, for example calibrated or calibratable arranged to intercept the discharge line 11.

The supplying line 3 and, if foreseen, the branch line 7 and/or the discharge line 10 can possibly be delimited through respective tubes or ducts (see in particular FIG. 2), possibly made of plastic or another suitable material, preferably fluid tight so as to prevent fluid (preferably air) leaking from them.

Advantageously, the storing means or locking/unlocking means 6 are intended and suitable for locking or fixing the outlet pressure at a desired outlet pressure during a first fluid filling or feeding cycle to a container and for maintaining the desired outlet pressure for fluid filling or feeding cycles to the container or to another container after the first feeding cycle.

Between the first feeding cycle and the subsequent feeding cycles there is a discharging step of the supplying line 3, as well as of the container 2 and, if foreseen, of the branch line 7 of the fluid previously inserted in them. Therefore, the storing means or locking/unlocking means 6 are intended and suitable for locking or fixing the outlet pressure at a desired outlet pressure both during a fluid filling or feeding cycle to a container and during a discharge step of the supplying line 3 and of a container 2.

With a device for feeding according to the present invention it is possible to supply a container 2 with a fluid, for example gaseous, possibly air at a predetermined pressure by suitably actuating the locking/unlocking means 6.

Concerning this, indeed, once the opening/closing valve 4 has been suitably actuated, possibly through a pedal PE1, the fluid is fed into the supplying line 3 and then into the container 2 to be fed or filled.

Leaving the opening/closing valve 4 open, the pressure in the device for feeding 1 continues to increase, until it reaches a value such as to ensure the correct filling of the container 2 and, in the case in which the container 2 is an actuator 2, the correct moving force of the stem 2*b* thereof.

At this point the storing means 6 are actuated, for example manually, possibly by moving the control valve 6*a* from the first position to the second position, thus closing the connecting conduit 6*b*, in which fluid thus remains at the desired filling pressure, which thus acts on the pressure adjusting member fixing or setting the outlet pressure thereof, for example suitably biasing a membrane, spear valve or movable wall thereof.

Once the filling cycle, possibly of the actuator 2, has ended, the opening/closing valve 4 is closed and then the supplying line 3, container 2 and, if foreseen, the branch line 7 are discharged of the fluid previously inserted therein, for example through suitable actuation of the discharge valve 10 or of another discharge valve, if foreseen by acting on a respective pedal PE2 for moving the latter.

Then, should a subsequent feeding or filling cycle be carried out, the connecting conduit 6*b* will be filled, as stated above, with fluid at the desired filling pressure and therefore the pressure adjusting member 5 set with desired outlet pressure, so that by actuating the opening/closing valve 4 the supply of fluid would take place through the supplying line 3 at the desired pressure, possibly through an initial step of increasing the pressure until the desired outlet pressure from the pressure adjusting member is obtained. In this case, the operator tasked with filling would be certain to fill or feed the container at the correct or desired pressure without having to control the filling or feeding steps.

According to the present invention an assembly for activating or moving 13 an object, for example for lifting a plane, possibly for a tyre or tyred wheel, is also provided, which assembly 13 comprises at least one actuator 2 including a cylinder 2*a* as well as a stem 2*b* movable as a function of the fluid fed or discharged from the latter and movable with a speed proportional to or in any case dependent on the feeding or discharge/suction pressure of the fluid. Possibly, the stem is fixed or operatively connected to a wall slidably mounted in the cylinder of the actuator and movable as a function of the fluid fed or discharged by the latter. The actuator could also have two or more cylinders and/or two or more stems.

The assembly 13 also comprises one or more devices for feeding 1, the dispensing end 3*b* of which is in fluid communication with the cylinder 2*a*, so as to allow fluid to be supplied or sucked into or from the latter.

As can be understood, this is particularly advantageous for the actuation at the same pressure of an actuator during a number of work or filling cycles. In this case, indeed, the first work or filling cycle could be carried out with storing means 6 in the first position, therefore, if foreseen, with branch line 7 open, and therefore, after suitable movement or control of the storing means 6, so as to lock or fix the outlet pressure of the pressure adjusting member 5 and therefore of the device for feeding 1. In this case, the work cycles after the first could be carried out with preset pressure adjuster and therefore with control valve 6*a* in the second position.

This of course offers a substantial advantage, since it becomes possible, with a very simple system, to feed or fill a container always at a same desired pressure, evaluated or established during a first filling cycle or pilot cycle, which means optimal feeding or filling during the cycles after the first, avoiding, among the other things, wasting the fluid by feeding it at excessive pressures.

In particular in the case in which the assembly for activating or moving 13 is to be used to lift a lifting plane of a tyre or a tyred wheel, during the first cycle or pilot cycle, the operator could actuate the locking/unlocking means once it has been established that the plane is lifted with sufficient speed and therefore that the fluid feeding pressure is sufficient for the weight of the wheel or tyre to be lifted, thus fixing the outlet pressure of the pressure adjusting member at a specific value. The successive lifting cycles of wheels or tyres with size and weight substantially corresponding to the first wheel or to the first tyre lifted during the pilot cycle, could therefore be lifted with adjustment component set at the outlet pressure fixed or set during the pilot cycle or first cycle. This, as can be understood, ensures lifting of the wheels or tyres at an optimal pressure.

A device and an assembly according to the present invention, moreover, do not need electronic controllers, but can be actuated and controlled with pneumatic or hydraulic means, although, as will be understood, if desired, such components could be implemented and foreseen.

According to the present invention, therefore, a method for feeding a fluid to a container is foreseen comprising the following steps:

- connecting a device for feeding 1, possibly as stated above, of a fluid on one side to a fluid source and on the other side to a container 2, such as an actuator 2 or rather a cylinder thereof;
- actuating an opening/closing valve 4 of the device for feeding 1 so as to allow fluid to be supplied from the fluid source to the device for feeding 1 and thus to the container 2;
- leaving the opening/closing valve 4 open so as to increase the pressure of the fluid in outlet from the device for feeding 1 (or rather from the pressure adjusting member 5) and in inlet or fed to the container 2;
- once the outlet pressure from the device for feeding 1 is sufficient to carry out a satisfactory or predetermined filling or feeding of the container 2 (for example filling of the cylinder of an actuator 2) storing or locking/unlocking means 6 (for example as stated above) are actuated so as to fix or set the outlet pressure from the device for feeding 1 (or rather from the pressure adjusting member 5);
- closing the opening/closing valve 4;
- discharging the container 2, preferably a cylinder 2*a* of an actuator;
- opening the opening/closing valve 4 so as to carry out another feeding or filling cycle of the container (actuator) or of another container previously connected to the device for feeding, with the device for feeding (or rather with the pressure adjusting member 5) having outlet pressure previously fixed or set.

With reference now to FIGS. 3 to 7, a lifting device of a tyre or a tyred wheel according to the present invention has also been illustrated, equipped with a support frame 15 movable between at least one lowered position and at least one raised position, a lifting plane 16 mounted on and movable through the support frame 15 between the lowered position (see FIGS. 4 and 6) and the raised position (see FIGS. 5 and 7), as well as, preferably at least one assembly for activating or moving, which is intended to lift/lower the lifting plane 16.

The assembly for activating or moving for a lifting device 14 according to the present invention comprises at least one actuator having at least one cylinder 2*a* as well as a stem 2*b* as stated above. The assembly also comprises at least one device for feeding fluid into the cylinder intended to control the movement of the stem and, therefore, of the frame 4.

The assembly for activating or moving is, preferably, an assembly 13 as stated above.

The lifting device 14 also comprises at least one connecting rod member 17 articulated, preferably hinged, on one side to the stem 2*b*, for example to an end thereof outside the cylinder, and on the other side to the frame 14, so that by feeding fluid into the cylinder 2*a* there is a movement of the stem 2*b* and of the connecting rod member 17 as well as, consequently, a movement of the frame 14 and therefore of the lifting plane 16.

Preferably, the cylinder 2*a* of the actuator 2 has a first end 2*c*, upper during use, and a second end 2*d*, lower during use, with the stem 2*b* slidably mounted in the second lower end 2*d*, so as to project downwards from the cylinder 2*a* and so that by injecting/sucking fluid into/from the cylinder 2*a* there is a withdrawal/insertion of the stem 2*b* from/in the cylinder 2*a* and a lowering of the end of the stem 2*b* articulated to the connecting rod member 17.

Possibly, the stem 2*b* can be slidably mounted along a direction substantially inclined with respect to the vertical.

As far as the support frame 15 is concerned, it can comprise at least one base 15*a* as well as a pair of arms or secondary frames 15*b*, 15*c* hinged together at a respective intermediate portion, one of the arms or secondary frames 15*b* having a first end 15*d*, preferably lower, hinged or articulated to the connecting rod member 17 and a second end 15*e*, preferably upper, supporting the lifting plane 16, whereas the other of the arms or secondary frames 15*c* has a first end 15*f*, preferably lower, slidably mounted at the base 15*a* and a second end 15*g*, preferably upper, supporting the lifting plane 16 and possibly hinged or articulated to the latter.

Even more preferably, the first end 15*d* of an arm or secondary frame 15*b* is arranged on a first side or front of the main frame 15, whereas the first end 15*f* of the other arm or secondary frame 15*c* is arranged on the other or second side or back of the main frame 15, and the second end 15*e* of an arm or secondary frame 15*b* is arranged on a second side or back of the main frame 15, whereas the second end 15*g* of the other arm or secondary frame 15*c* is arranged on the first side or front of the main frame 15. With such a structure, the main frame is configured substantially like a fork.

Each secondary frame 15*b*, 15*c* can for example comprise two shafts or profiles that are substantially parallel and bridge-connected through respective cross members, possibly a respective base cross member and a respective top cross member.

Preferably, the connecting rod member 17 is hinged to the stem 2*b* about an axis substantially parallel to the hinging axis between the arms 15*b*, 15*c* and, possibly of the ends thereof to the other members of the lifting device.

Advantageously, once the stem 2*b* is in retracted position in the respective cylinder 2*a*, the connecting rod member 17 has a substantially inclined configuration with respect to the vertical with a first end 17*a* hinged to a respective arm 15*b* and a second end 17*b* hinged to the stem 2*b* and at a higher level with respect to the first end 17*a*, whereas when the stem 2*b* is in extended position out from the cylinder 2*a* the second end 17*b* of the connecting rod member 17 is in lowered position, in other words at a level lower with respect to the condition with stem 2*b* in retracted position. Even more advantageously, when the stem 2*b* is in extended position, the connecting rod member 17 has a substantially horizontal configuration.

Preferably, the assembly for activating or moving is arranged outside the main frame 15 and, even more preferably extends on the front or on the back thereof.

Advantageously, the lifting device 14 can comprise a slide member 18 slidably mounted on the lifting plane 16 and intended to allow a tyre or tyred wheel to be moved along the longitudinal extension of the plane itself.

The lifting device 14 can also comprise a grasping handle 19, for example rising up from the lifting plane 16.

As will be understood, a lifting device according to the present invention is structured so that, once the activation assembly has been actuated, the extension of the stem 2*b* quickly and efficiently controls the movement of the connecting rod member 17 and therefore the lifting movement of the main frame 15 and therefore of the lifting plane 16. Then by commanding the stem 2*b* backwards so as to make it retract in the cylinder 2*a* a backwards lowering movement of the plane 16 is obtained.

A lifting device according to the present invention, thus unlike conventional lifting devices, ensures quick and efficient application of the lifting force.

Moreover, by equipping a lifting device with an assembly for activating or moving as stated above, it is possible during a first work cycle or pilot cycle to lift a wheel and, during the lifting to set or fix, through the locking/unlocking means, the outlet pressure of the pressure adjusting member so as to ensure the lifting, possibly with a desired speed, of the wheel and thus carry out the successive lifting cycles of wheels with size and, in particular, weight corresponding to that of the wheel lifted during the pilot cycle, with locking/unlocking means in the second position, thus with outlet pressure of the pressure adjusting member fixed or set.

According to the present invention a method for lifting/lowering wheels or tyres is provided, preferably carried out or achieved through a lifting device 14, which foresees to arrange a lifting device 14 having a support frame 15 movable between at least one lowered position and at least one raised position, a lifting plane 16 mounted on and movable through the support frame 15 between the lowered position and the raised position, as well as one or more actuators 2 connected to a fluid supplying device, preferably a device for feeding 1, the actuator 2 being intended to lift/lower the lifting plane 16.

Therefore, a first wheel or a first tyre is arranged on the lifting plane 16 in lowered position and the device for feeding 1 of a fluid is connected (before or after having arranged the wheel on the plane) on one side to a fluid source and on the other side to a cylinder 2*a* of the actuator 2.

At this point, an opening/closing valve 4 of the device for feeding 1 is actuated so as to allow fluid to be supplied from the fluid source (possibly a compressor) to the device for feeding 1 and thus to the cylinder 2 of the actuator 2 and the opening/closing valve 4 is left open so as to increase the pressure of the fluid in outlet from the device for feeding 1 and in inlet or fed to the container or actuator 2 or to a cylinder 2*a* thereof.

When it has been verified that the outlet pressure from the device for feeding 1 is sufficient to carry out a satisfactory or predetermined lifting of the lifting plane 16, storing or locking/unlocking means, for example the locking/unlocking means 6, are actuated, thereby fixing or setting the outlet pressure from the device for feeding 1 (or from the adjusting member thereof).

Then the opening/closing valve 4 is closed, the cylinder 2 of the actuator 2 is discharged of the fluid foreseen in it, then taking the lifting plane 16 back into the lowered position.

At this point the first wheel or tyre previously lifted is picked up from the lifting plane 16 and a second tyre or wheel is placed on the lifting plane 16, which second tyre or wheel preferably has substantially the same size or weight as the first wheel lifted and thereafter the opening/closing valve 4 is opened again so as to carry out another feeding cycle of the actuator connected to the device for feeding and thus a lifting cycle of the second tyre or wheel, with the device for feeding having outlet pressure previously fixed/set.

Alternatively, the wheels could be picked up also from the lifted plane 16, for example made to roll or moved on suitable work tables and then unloaded from it therefore without it being necessary to take them back onto the plane 16 to unload them.

It should be understood that with a device or method according to the present invention, after having lifted a wheel or a tyre, it can be transferred onto a wheel-carrying table of a tyre mounting/dismounting machine or of another machine for processing or treating the wheel/tyre. Alternatively, the lifted wheel or tyre can be treated/processed by keeping it on the lifted plane.

Modifications and variants of the invention are possible within the scope of protection defined by the claims.

Thus, for example, the locking/unlocking means could be different from those described above and be foreseen, for example, on the supplying line, or on the pressure adjusting member itself.

The invention claimed is:

1. A device for feeding a fluid to a container comprising:

at least one supplying line for supplying said fluid;

at least one inlet end for the inlet of the fluid into said at least one supplying line, said at least one inlet end being designed to be put in fluid communication with a fluid source;

at least one dispensing end for dispensing the fluid into said container;

at least one opening/closing valve member intercepting said at least one supplying line and which is movable between a closing position, wherein it obstructs the fluid supplying between said at least one inlet end and said at least one dispensing end, and at least one opening position, wherein it allows the fluid supplying between said at least one inlet end and said at least one dispensing end;

at least one pressure adjusting member intercepting said at least one supplying line and designed to receive in inlet said fluid at an inlet pressure and to supply it at an outlet pressure, said pressure adjusting member having a variable outlet pressure; and locking/unlocking means movable between a condition of setting or fixing said outlet pressure exiting from said pressure adjusting member and a resting condition, wherein said locking/unlocking means comprise at least one control valve arranged to intercept said supplying line or a branch line of said supplying line as well as at least one fluid connecting conduit between said control valve and said pressure adjusting member, said control valve being movable between a position wherein it allows the fluid flowing from said supplying line or said branch line to said connecting conduit and a position wherein it closes said connecting conduit.

2. The device according to claim 1, wherein said locking/unlocking means in said resting condition do not neither fix nor set said outlet pressure.

3. The device according to claim 1, wherein said pressure adjusting member has a variable through-flow section and wherein said locking/unlocking means are movable between a condition of setting or fixing said through-flow section and a condition of at least partial unlocking of said through-flow section, wherein they do not fix said through-flow section.

4. The device for feeding according to claim 1, wherein said pressure adjusting member comprises at least one chamber wherein at least one membrane, spear valve or movable wall is slidably mounted so as to vary the outlet pressure exiting from said pressure adjusting member and wherein said at least one connecting conduit is in fluid communication with said chamber and is designed to supply fluid into said chamber so as to bias said membrane, spear valve or said movable wall, thereby determining the outlet pressure of said pressure adjusting member.

5. The device for feeding according to claim 1, wherein said branch line extends between a portion of said supplying line upstream of said pressure adjusting member and a portion of said supplying line downstream of said pressure adjusting member or between a portion of said supplying line upstream of said pressure adjusting member and said pressure adjusting member.

6. The device for feeding according to claim 1, wherein said locking/unlocking means comprise a button for automatically or manually activating or switching said control valve between said first and said second position.

7. The device for feeding according to claim 1, comprising a device for feeding a pressurized gaseous fluid to an actuator.

8. The device according to claim 1, wherein said locking/unlocking means are intended and suitable for locking or fixing said outlet pressure at a desired outlet pressure during a first feeding cycle of fluid to a container and for maintaining said desired outlet pressure for feeding cycles of said container or of another container after said first feeding cycle.

9. The device according to claim 1, wherein said locking/unlocking means are of the on/off type or with only two conditions or positions comprising a condition of setting or fixing of the outlet pressure from the pressure adjuster and said resting condition.

10. The device according to claim 1, comprising a discharge valve as well as a fluid discharge line extending between an end portion of said supplying line and said discharge valve.

11. The device according to claim 8, comprising a discharge valve as well as a fluid discharge line extending between an end portion of said supplying line and said discharge valve, wherein said storing means or locking/unlocking means are intended and suitable for locking or fixing said outlet pressure at a desired outlet pressure value both during a fluid filling or feeding cycle to a container and during a discharge step of said container.

12. An assembly for activating or moving an object comprising at least one actuator including at least one cylinder as well as at least one stem movable as a function of the fluid fed or discharged from said at least one cylinder, said assembly further comprising at least one device for feeding according to claim 1, the dispensing end of said device for feeding being in fluid communication with said cylinder and is adapted to feed fluid thereto/therein.

13. A lifting device for a tyre, comprising at least one support framework movable between at least one lowered position and at least one lifted position, a lifting platform mounted on and movable through said support framework between said lowered position and said lifted position, as well as at least one assembly for activating or moving according to claim 12 designed to lift-lower said lifting platform.

14. The lifting device according to claim 13, comprising at least one connecting rod member articulated or hinged on one side to said at least one stem and on the other side to said support framework, so that by feeding/suctioning fluid to or from said at least one cylinder a displacement of said at least one stem and of said at least one connecting rod member is obtained as well as, accordingly, a displacement of said support framework and therefore of said lifting platform is obtained.

15. The lifting device according to claim 13, wherein said support framework comprises at least one base as well as a pair of arms which are hinged or operatively connected to one another at a respective intermediate portion, one of said arms having a first end hinged to said at least one connecting rod member and a second upper end supporting said lifting platform, whereas the other of said arms has a first end slidably mounted with respect to said base and a second end supporting said lifting platform.

16. A method for feeding a fluid to a container comprising the following steps:

connecting a device for feeding a fluid on one side to a fluid source and on the other side to a container;

activating an opening-closing valve of said device for feeding so as to allow the fluid supplying from said fluid source to said device for feeding and thus to said container;

leaving said opening-closing valve open so as to increase the fluid pressure exiting from said device for feeding and entering or being fed to said container;

when the pressure exiting from said device for feeding is sufficient to perform a satisfying or predetermined feeding or filling of said container, activating locking/unlocking means so as to fix or set the pressure exiting from said device for feeding;

closing said opening-closing valve;

discharging said container;

opening said opening-closing valve so as to perform a new feeding or filling cycle of said container or of another container connected to said device for feeding, while said device for feeding has fixed or set outlet pressure.

17. The method for feeding according to claim 16, wherein said container comprises an actuator including at least one cylinder as well as at least one stem movable according to the fluid fed/discharged to/from said at least one cylinder.

18. The method for feeding according to claim 16 by means of a device for feeding according to claim 1.

19. A method for lifting-lowering wheels or tyres, comprising the following steps:

pre-arranging a lifting device for a tyre or a tired wheel provided with a support framework movable between at least one lowered position and at least one lifted position, a lifting platform mounted on and movable through said support framework between said lowered position and said lifted position, as well at least one actuator connected to a device for feeding fluid, said actuator being adapted to lift-lower said lifting platform;

arranging a first wheel or a first tyre on said lifting platform;

connecting said device for feeding fluid on one side to a fluid source and on the other side to a cylinder of said actuator;

activating an opening-closing valve of said device for feeding so as to allow the fluid supplying from said fluid source to said device for feeding and thus to said cylinder of said actuator;

leaving said opening-closing valve open so as to increase the fluid pressure exiting from said device for feeding and entering said container;

when the pressure exiting from said device for feeding is sufficient to perform a satisfying or predetermined lifting of said lifting platform, activating locking/unlocking means so as to fix or set the pressure exiting from said device for feeding;

closing said opening-closing valve;

discharging said cylinder of said actuator;

bringing said lifting platform back to said lowered position;

removing said previously lifted first wheel or first tyre from said lifting platform;

putting a second tyre or wheel on said lifting platform, said second tyre or wheel having substantially the same size or weight of said first tyre or first wheel;

opening said opening-closing valve so as to perform a new filling cycle of said actuator connected to said device for feeding and thus a lifting cycle of said second tyre or wheel, while said device for feeding has a previously fixed or set outlet pressure.

20. The method for lifting a wheel or a tyre according to claim 19, wherein said method is carried out by means of a lifting device according to claim 13.

21. A device for feeding a fluid to a container comprising:

at least one supplying line for supplying said fluid;

at least one inlet end for the inlet of the fluid into said at least one supplying line, said at least one inlet end being designed to be put in fluid communication with a fluid source;

at least one dispensing end for dispensing the fluid into said container;

at least one opening/closing valve member intercepting said at least one supplying line and which is movable between a closing position, wherein it obstructs the fluid supplying between said at least one inlet end and said at least one dispensing end, and at least one opening position, wherein it allows the fluid supplying between said at least one inlet end and said at least one dispensing end;

at least one pressure adjusting member intercepting said at least one supplying line and designed to receive in inlet said fluid at an inlet pressure and to supply it at an outlet pressure, said pressure adjusting member having a variable outlet pressure; and locking/unlocking means movable between a condition of setting or fixing said outlet pressure exiting from said pressure adjusting member and a resting condition, wherein said locking/unlocking means are intended and suitable for locking or fixing said outlet pressure at a desired outlet pressure during a first feeding cycle of fluid to a container and for maintaining said desired outlet pressure for feeding cycles of said container or of another container after said first feeding cycle.

22. A lifting device for a tyre, comprising at least one support framework movable between at least one lowered position and at least one lifted position, a lifting platform mounted on and movable through said support framework between said lowered position and said lifted position, as well as at least one assembly for activating or moving an object and designed to lift-lower said lifting platform, said assembly comprising at least one actuator including at least one cylinder as well as at least one stem movable as a function of the fluid fed or discharged from said at least one cylinder, said assembly further comprising at least one device for feeding a fluid to a container comprising:

at least one supplying line for supplying said fluid;

at least one inlet end for the inlet of the fluid into said at least one supplying line, said at least one inlet end being designed to be put in fluid communication with a fluid source;

at least one dispensing end for dispensing the fluid into said container;

at least one opening/closing valve member intercepting said at least one supplying line and which is movable between a closing position, wherein it obstructs the fluid supplying between said at least one inlet end and said at least one dispensing end, and at least one opening position, wherein it allows the fluid supplying between said at least one inlet end and said at least one dispensing end;

at least one pressure adjusting member intercepting said at least one supplying line and designed to receive in inlet said fluid at an inlet pressure and to supply it at an outlet pressure, said pressure adjusting member having a variable outlet pressure; and locking/unlocking means movable between a condition of setting or fixing said outlet pressure exiting from said pressure adjusting member and a resting condition, the dispensing end of said device for feeding being in fluid communication with said cylinder and is adapted to feed fluid thereto/therein, the lifting device further comprising at least one connecting rod member articulated or hinged on one side to said at least one stem and on the other side to said support framework, so that by feeding/suctioning fluid to or from said at least one cylinder a displacement of said at least one stem and of said at least one connecting rod member is obtained as well as, accordingly, a displacement of said support framework and therefore of said lifting platform is obtained.

23. A lifting device for a tyre, comprising at least one support framework movable between at least one lowered position and at least one lifted position, a lifting platform mounted on and movable through said support framework between said lowered position and said lifted position, as well as at least one assembly for activating or moving an object and designed to lift-lower said lifting platform, said assembly comprising at least one actuator including at least one cylinder as well as at least one stem movable as a function of the fluid fed or discharged from said at least one cylinder, said assembly further comprising at least one device for feeding a fluid to a container comprising:

at least one supplying line for supplying said fluid;

at least one inlet end for the inlet of the fluid into said at least one supplying line, said at least one inlet end being designed to be put in fluid communication with a fluid source;

at least one dispensing end for dispensing the fluid into said container;

at least one opening/closing valve member intercepting said at least one supplying line and which is movable between a closing position, wherein it obstructs the fluid supplying between said at least one inlet end and said at least one dispensing end, and at least one opening position, wherein it allows the fluid supplying between said at least one inlet end and said at least one dispensing end;

at least one pressure adjusting member intercepting said at least one supplying line and designed to receive in inlet said fluid at an inlet pressure and to supply it at an outlet pressure, said pressure adjusting member having a variable outlet pressure; and locking/unlocking means movable between a condition of setting or fixing said outlet pressure exiting from said pressure adjusting member and a resting condition, the dispensing end of said device for feeding being in fluid communication with said cylinder and is adapted to feed fluid thereto/therein, wherein said support framework comprises at least one base as well as a pair of arms which are hinged or operatively connected to one another at a respective intermediate portion, one of said arms having a first end hinged to said at least one connecting rod member and a second upper end supporting said lifting platform, whereas the other of said arms has a first end slidably mounted with respect to said base and a second end supporting said lifting platform.

* * * * *